US005303830A

United States Patent [19]

Metcalf

[11] Patent Number: 5,303,830

[45] Date of Patent: Apr. 19, 1994

[54] EXTENSION ASSEMBLY FOR MERCHANDISE DISPLAY RACKS

[75] Inventor: Derek N. G. Metcalf, LaGrange Park, Ill.

[73] Assignee: Athena Industries, Inc., LaGrange, Ill.

[21] Appl. No.: 5,027

[22] Filed: Jan. 15, 1993

[51] Int. Cl.[5] ..... A47F 5/00

[52] U.S. Cl. ..... 211/57.1; 211/59.1; 211/103; 211/208

[58] Field of Search ..... 211/59.1, 57.1, 103, 211/208, 94, 189; 248/222.2, 225.1

[56] References Cited

U.S. PATENT DOCUMENTS

| | | | |
|---|---|---|---|
| 3,139,985 | 7/1964 | Sinclair | 211/59.1 |
| 3,221,893 | 12/1965 | Glaberson et al. | 211/103 X |
| 4,007,841 | 2/1977 | Seipel . | |
| 4,155,458 | 5/1979 | Moline . | |
| 4,501,369 | 2/1985 | Fox . | |
| 4,550,893 | 11/1985 | Wiersema et al. | 211/103 X |
| 4,606,466 | 8/1986 | Fredrickson . | |
| 4,693,381 | 9/1987 | Lodge . | |
| 4,826,022 | 5/1989 | Duarte . | |
| 4,869,378 | 9/1989 | Miller . | |
| 4,884,702 | 12/1989 | Rekow . | |
| 4,936,565 | 6/1990 | Fredrickson . | |
| 5,031,783 | 7/1991 | Goudreau . | |

*Primary Examiner*—Robert W. Gibson, Jr.
*Attorney, Agent, or Firm*—McCaleb, Lucas & Brugman

[57] ABSTRACT

An assembly for vertically extending a gondola display area which includes a pair of upright extension tubes, each with a single protruding mounting hanger connectable with slotted openings in tubular vertical uprights of the display framework; adjustment and locking brackets fasten to each extension tube, above and below the mounting hanger thereon, for pivotally adjusting and locking the extension tubes in parallel relation to support one or more horizontal cross bars having elongated retention rods for coupling plural detachable merchandise display elements to the crossbars.

10 Claims, 4 Drawing Sheets

FIG. 13
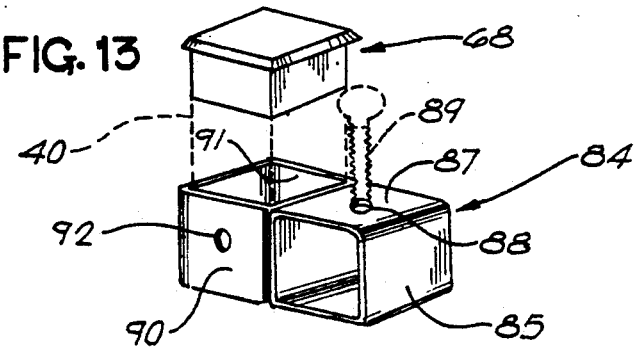
FIG. 14
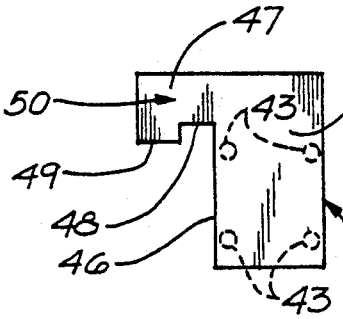
FIG. 16
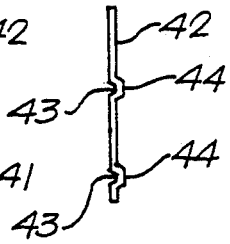
FIG. 17
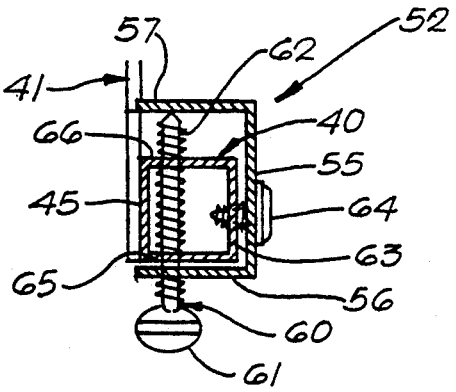
FIG. 15
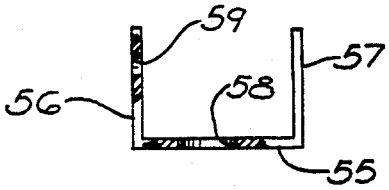
FIG. 19
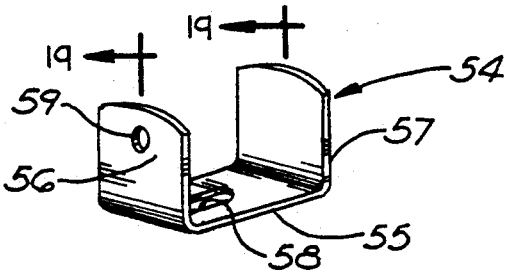
FIG. 18

EXTENSION ASSEMBLY FOR MERCHANDISE DISPLAY RACKS

This invention pertains to merchandise displays and more particularly to an improved assembly for vertically extending and augmenting the display area of a conventional gondola display rack.

BACKGROUND OF THE INVENTION

Gondola displays to which the present invention is particularly directed generally are formed as free-standing or, at times, wall mounted vertical racks, frequently supporting peg board panels and/or horizontal cross bars to which various brackets, hooks or other support elements are attached for the purpose of displaying merchandise. In the more familiar installations gondola displays are floor mounted, free standing racks usually arranged to form a series of spaced partitions definitive of shopping aisles. This arrangement is necessarily limited by available floor space. However, since such displays are normally about six feet in height or less, there is considerable unused overhead space available for additional display.

It is readily apparent that this available space may be utilized by simply purchasing higher or bigger display racks. However, this solution is not economically appealing due to the heavy investment involved in buying such new equipment. Thus, there is a distinct need and demand for a simple, relatively inexpensive means for increasing the available display capacity of typical gondola display systems.

BRIEF SUMMARY OF THE INVENTION

This invention is directed toward a simple and effective solution to the aforedescribed problem.

In brief, the extension assembly of this invention comprises a pair of elongated, preferably tubular metal extension members, each with a single protruding mounting hanger or hook located intermediate its ends for attachment to vertical upright frame members of the conventional gondola display rack whereby to extend the height of such uprights. The hangers of the extension members are insertible into selected spaced slotted openings formed in the vertical uprights of the gondola framework. Two adjustment brackets embrace each extension member, one above and one below the mounting hanger thereon, such that adjustment movement of these brackets toward and away from the gondola's associated vertical upright members serve to align the extension members parallel to one another and to the vertical uprights. At least one elongated article supporting crossbar is extended horizontally between the two vertically disposed extension members and is attached thereto by novel connector brackets which may be adjustably positioned and locked to the extension and horizontal support members. In order to support articles of merchandise for customer display at least one elongated retention rod is fixed along the length of the horizontal support member so as to lie in spaced parallelism therewith. The spacing between the retention rod and the support member receives the connective ends of novel article support elements which are adapted to slide adjustably along the support member and project outwardly therefrom in cantilever fashion to receive articles to be displayed thereon.

A primary object of this invention is to provide an improved, simple and economical assembly for extending the height and display area of a conventional gondola display rack.

Another important object of this invention is to provide a new and improved connector means for interjoining transverse tubular members.

Still another object of this invention is to provide a simplified article support element having a quick acting connector means at one end for detachably coupling the same to a horizontal support member.

A still further object of this invention is to provide an improved extension assembly, mountable to the upper end of a gondola display, comprising vertical extension members attached to vertical uprights of the gondola display in a manner permitting adjustable movement of the extension members into parallel vertical relationship.

Having described this invention the above and further objects, features and advantages thereof will be recognized by those skilled in the art from the following description of a preferred embodiment thereof, illustrated in the accompanying drawings and representing the best mode presently contemplated for enabling those of skill in the art to practice this invention.

IN THE DRAWINGS

FIG. 13 is a perspective view of a cover cap for closing over the upper end of a vertical extension member shown in FIG. 1;

FIG. 14 is a perspective view of an adjustment bracket for attaching the horizontal article support member to the vertical extension members, shown in FIG. 1;

Figure 1:
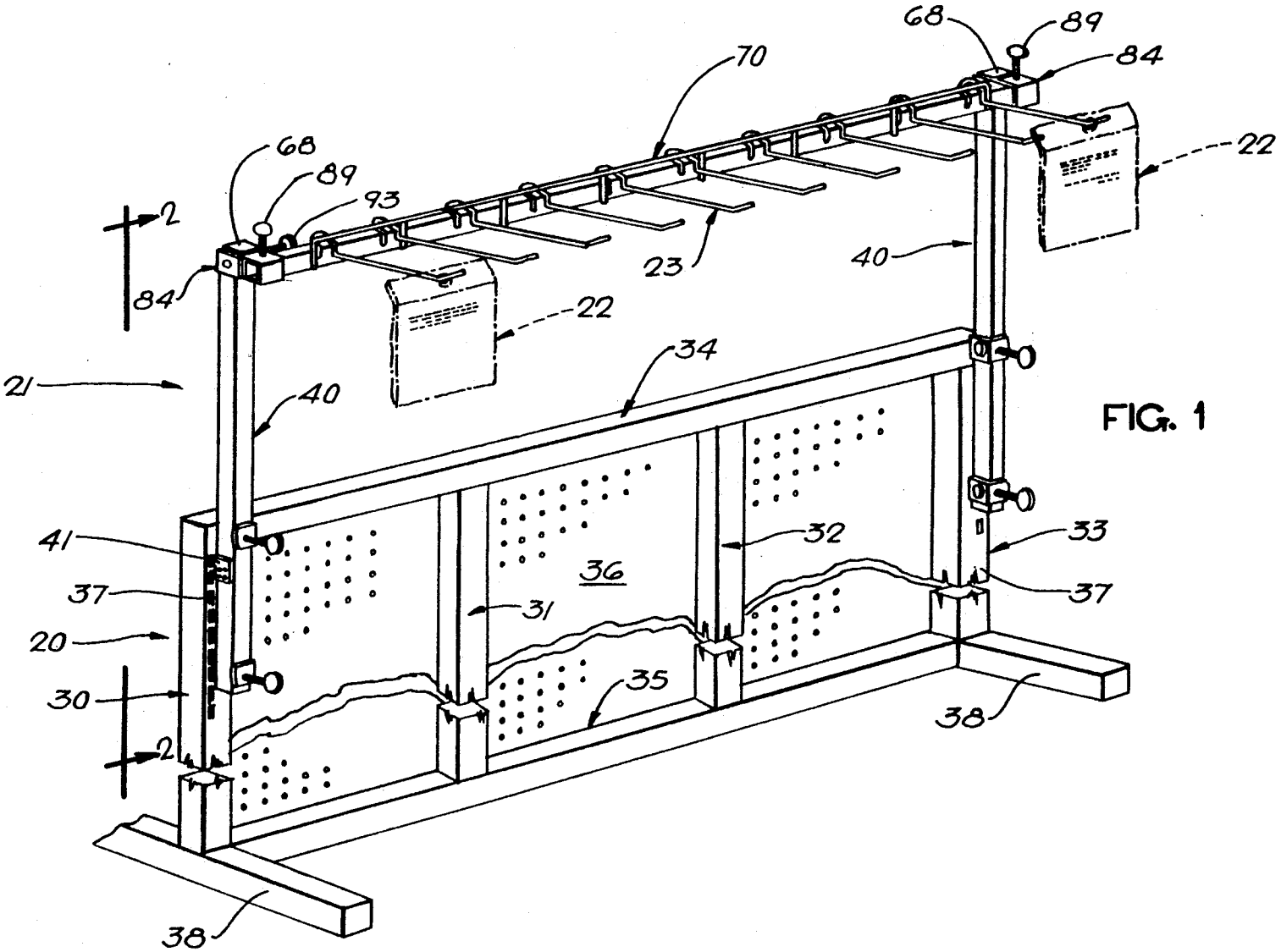
FIG. 1 is a frontal perspective of a gondola display equipped wit extension assembly of this invention.
Figure 2:
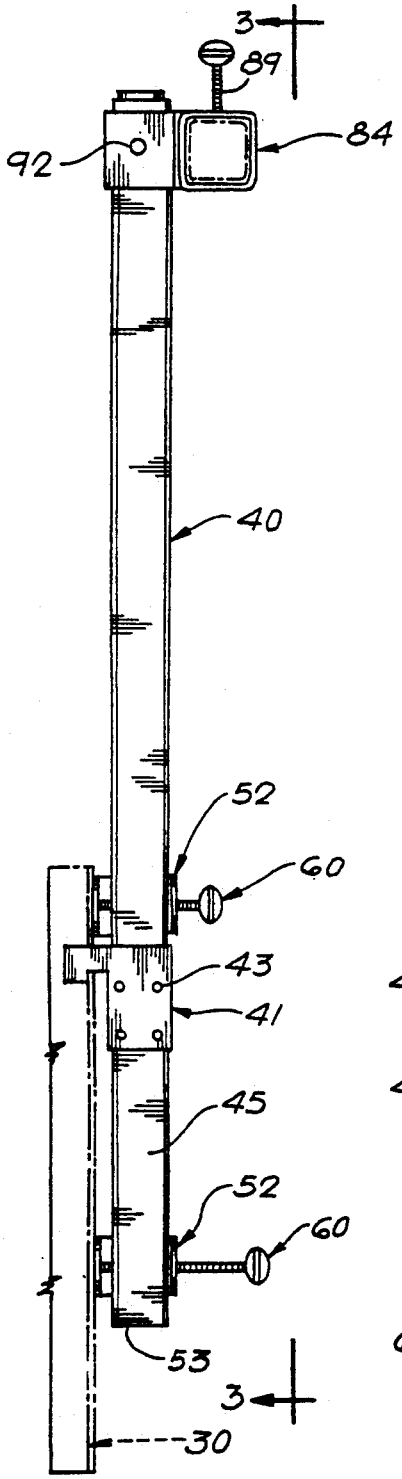
FIG. 2 is a left hand partial side elevation of the display and extension assembly shown in FIG. 1, taken substantially along vantage line 2—2 of FIG. 1 and looking in the direction of the arrows thereon.
Figure 3:
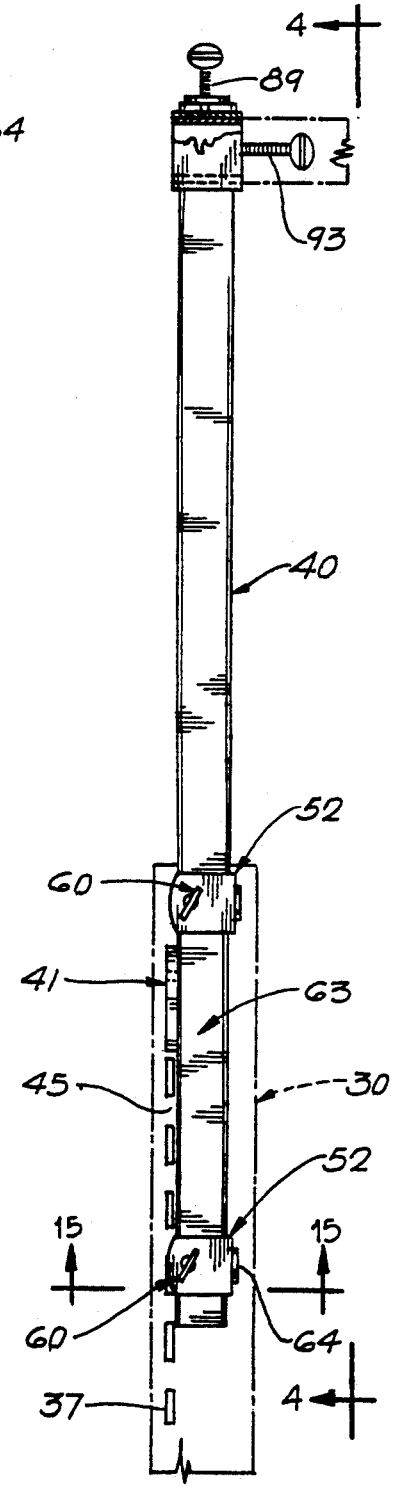
FIG. 3 is a front elevation of the assembly shown in FIG. 2, taken substantially along vantage line 3—3 of that figure and looking in the direction of the arrows thereon.
Figure 4:
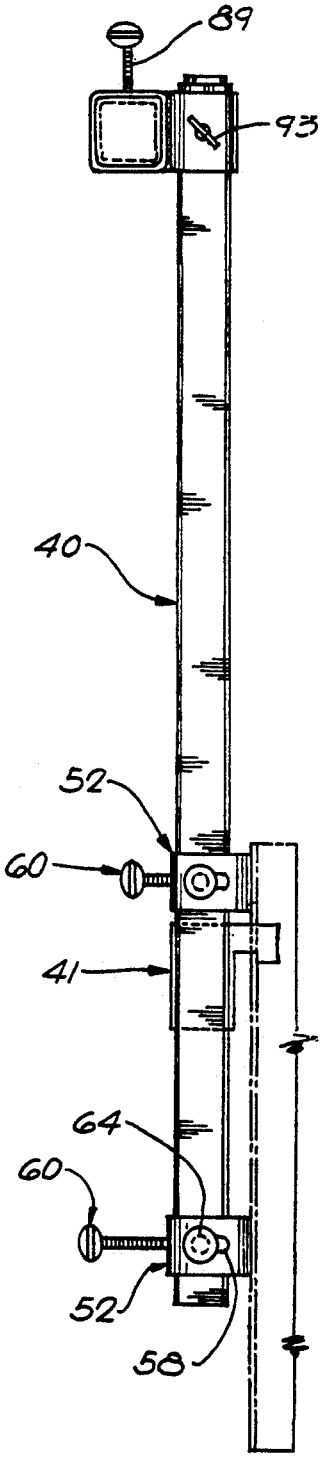
FIG. 4 is a right hand side elevation of the assembly shown in FIGS. 2 and 3, taken substantially along vantage line 4—4 of FIG. 3 and looking in the direction of the arrows thereon.

FIG. 15 an enlarged cross sectional view, taken substantially a vantage line 15—15 of FIG. 3 and looking in the direction of the arrows thereon;

FIG. 16 is a front elevation of an hanger hook shown in FIGS. 2 and 4;

FIG. 17 is a right hand side elevation of the hanger shown in FIG. 16;

FIG. 18 is a perspective view of the slide member of an adjustment bracket associated with each vertical upright of the extension assembly as shown in FIGS. 1 and 15; and FIG. 19 is a full cross sectional view of the adjustment bracket slide member of FIG. 18, taken substantially along vantage line 19—19 of FIG. 18 and looking in the direction of the arrows thereon.

DESCRIPTION OF THE PREFERRED EMBODIMENT

Turning now to the features of the preferred embodiment of this invention illustrated in the accompanying drawings, initial reference is made to FIG. 1 wherein a typical gondola display rack, indicated generally at 20, is shown having an extension assembly 21 in accordance with this invention mounted across the upper end thereof for displaying a plurality of packaged articles 22 (shown in dotted lines) mounted on novel cantilever support elements 23.

The gondola display 20 comprises a plurality of vertical uprights 30–33 which are disposed in laterally spaced relation and cross connected at their upper and lower ends by horizontal bars 34 and 35. The various members 30–35 are preferably formed of rectangular cross section tubular stock suitably welded together to formulate a generally rectangular framework which may support a peg board or other planar panel indicated at 36. The two laterally-most uprights 30 and 33 are distinguished by a plurality of spaced slotted openings 37 extending in a vertical alignment along one face thereof and transversely extending pedestal legs 38, 38 extending across the bottom ends of the members 30, 33 to formulate a stabilizing pedestal for holding the gondola frame in an upright operating condition. The pedestal forming members 38 may constitute either a T-shaped pedestal as illustrated or in some instances may extend only to one side of the vertical uprights forming an L-shaped pedestal, depending on installation requirements.

In use, the peg board panel 36 is fitted with a plurality of hooks or other peg board mounted elements for displaying packaged goods, tools or other articles in viewing position for the buying public. In other instances, transverse bars are extended across the width of the gondola frame and are joined thereto by hook hangers which fit into selected openings 37 in the outboard upright members 30 and 33 to support appropriate fastener elements.

It will be understood of course that the gondola display of the order briefly outlined above is a known commercially available structure which typically is used in retail supermarkets for displaying hardware items, convenience articles, groceries, such as packages meats, etc., typified for example by U.S. Pat. No. 4,606,466, issued Aug. 19, 1986 as well as other similar structures known in the art. Such gondola displays do not constitute any part of the present invention other than typifying a support for the extension assembly 21 hereof. It is important to note that regardless of the specifics of the gondola display it is necessary that the outboard upright members thereof be provided with a plurality of hanger receptive openings such as the slotted openings 37 shown in FIG. 1, so that the extension assembly hereof may be attached to the gondola display to extend the conventional height thereof for purposes of achieving a greater article display area. That being the case, the detailed features of the improved extension assembly 21 will now be set forth.

As best shown in FIGS. 1–4 of the drawings, extension assembly 21 includes a pair of upright extension members 40, 40; preferably, as shown, linear tubular metal members having a substantially square cross section and of an appropriate length to effect the desired extension of the gondola uprights 30 and 33. For purposes of attaching the members 40, 40 to the gondola uprights, each of the extension members 40 is provided with a single hanger member 41 located intermediate its ends and at a position closer to its lower end (see FIG. 2).

As best shown in FIGS. 16 and 17, the slot hanger members 41 constitute a generally rectangular, planar main body portion 42 having four dimples 43 pressed in one face to form weld projections 44 on the opposite face of the body portion for purposes of welding the hanger to the outboard face 45 of an associated extension member 40, in the illustrated embodiment. At its upper end the body portion 42 of the hanger member extends laterally outwardly of one edge 46 thereof to provide a generally rectangular hook portion 47 having a notch 48 inset in the lower edge 49 thereof. It will be understood that the notch 48 in conjunction with the non-cut away area or laterally adjacent portion of the arm portion 47 forms a slot hook 50 which is adapted to enter slotted openings 37 in a vertical upright 30 or 33 of the gondola framework and loosely couple the hanger member 41 and attached extension member 40 to the gondola at a desired position of elevation. (see FIGS. 2 and 4 of the drawings). So loosely mounted on the gondola upright members each extension member 40 must be secured vertically upright and stabilized. To that end a pair of adjustment and locking brackets 52, 52 of identical structure are provided one immediately above hanger member 41 and the other therebelow adjacent the lower end 53 of the extension member.

The features of the brackets 52 will be recognized from FIGS. 1–4, 15, 18 and 19 of the drawings. As shown best in FIG. 18 each bracket 52 comprises a rigid, metal, substantially U-shaped slide member 54 having a planar main body portion 55 integral with a pair of parallel, spaced arms 56, 57; the outer ends of which are curved or rounded over to avoid sharp corners. The planar body portion 55 is distinguished by an elongated slotted opening 58 generally extending from substantially the mid-point of the body portion toward one arm 56. Such arm 56 is distinguished by cylindrical opening 59 for reception of a thumb bolt 60 having a finger engaging portion 61 at one end and an elongated threaded body portion 62. It is to be noted that the bolt body passes freely through opening 59 for reasons which will appear shortly.

In operation each bracket assembly 52 is disposed about one of the extension members 40 as shown in FIGS. 2–4 opposite a threaded opening formed through an inboard wall 63 thereof for threaded reception of a sheet metal screw 64 which passes through the slotted opening 58 in the bracket body 55. Alternatively, the sheet metal screw 64 may be of nylon or similar plastic capable of being inserted through the threaded opening formed in the inboard wall 63 of the tubular extension member 40. Once the screw member 65 is engaged with the wall 63 of the extension member the bracket is located so that the thumb screw 60 may pass freely through opening 59 and threadingly engage registeringly aligned openings (not shown) formed through front and back walls 65 and 66 of the extension member 40. It will be noted that as the threaded body 62 of the thumb bolt advances through the opposing walls 65 and 66 of the extension member, the outer end of the bolt projects or extends beyond wall 66 to engage the inner face of arm 57 of the slide member causing the slide member to move toward the adjacent vertical upright 30 of the gondola framework as shown in FIGS. 2 and 4. Engagement of arm 57 of the upper bracket assembly with the adjacent wall of the gondola upright 30 serves to pivot the extension member 40 about the slot hook 50 as a fulcrum. In this fashion the extension member 40 is aligned vertically parallel to the upright 30 of the gondola frame. Inasmuch as there is a second bracket assembly 52 located adjacent the lower end of the extension member, operation of the thumb screw 60 of the second assembly causes arm 57 thereof to engage the adjacent face of the gondola upright 30 and lock the extension member 40 in its vertical upright position; the two bracket assemblies 52 pulling the slot hook 50 tightly against the inside face of the front wall of the gondola upright in which slotted openings 37 are formed. Once the two bracket assemblies 52 are tightened and the extension members 40 aligned in a vertical attitude parallel to the gondola upright members 30 and 33, the later are stabilized in that position by virtue of the screw tightened engagement of the arms 57 against the-front wall of the gondola frame uprights.

With reference now to FIGS. 1 and 5–12 of the drawings, the remainder of the extension assembly 21 and particularly the means for supporting articles thereon for display purposes now will be described.

As best shown in FIGS. 1 and 13 of the drawings, the two upright extension members 40, 40 are closed at their upper ends by caps 68, 68 and support a horizontally extending crossbar assembly 70 therebetween from which the articles to be sold or displayed for sale (indicated at 22) are supported by cantilever support elements 23.

Figure 5:
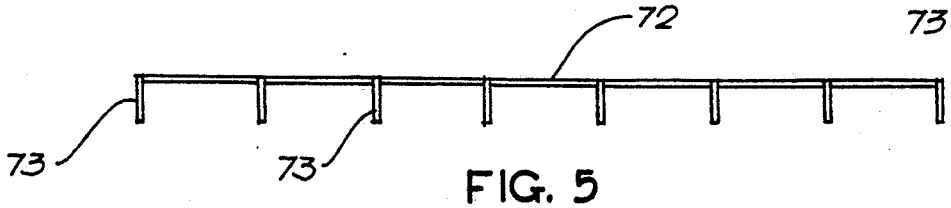
FIG. 5 is a front elevation of the retention rod of the crossbar assembly shown in FIG. 1.
Figure 6:
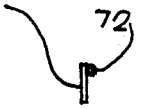
FIG. 6 is a left hand side end elevation of the assembly shown in FIG. 5.
Figure 7:
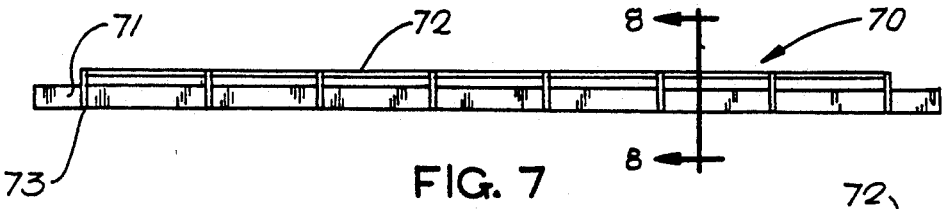
FIG. 7 is a front elevation of the assembled retention rod and horizontal crossbar shown in FIG. 1.
Figure 8:
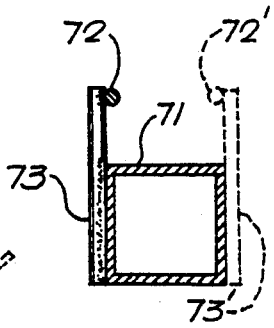
FIG. 8 is an enlarged transverse cross sectional view taken along vantage line 8—8 of FIG. 7, looking in the direction of the arrows thereon and showing a modified double retention rod assembly indicated in dotted lines.

With particular reference to FIGS. 5–8 of the drawings, it will be recognized that the assembly 70 constitutes a length of suitably dimensioned square metal tubing 71 which extends between the two extension members 40, 40. A linear cylindrical retention rod 72 of a length slightly less than the length of tube 71 is fixed to a plurality of spaced depending support fingers 73, as shown in FIG. 5. It will be noted that the upper ends of the support finger 73 are welded to the retention rod while the lower or depending portions thereof are welded in fixed position on an adjacent front face or wall of the tube member 71. As indicated in FIGS. 7 and 8 the retention rod 72 is disposed on the rearward side of the support fingers 73 so that the retention rod lies over the upper side of the tubular support member 71 (see FIG. 8). In the particular embodiment illustrated in FIG. 7 it will be recognized that only a single support or retention rod is so mounted on the tubular member 71 with the rod 72 being elevated above the upper face of the tubular member to provide a space for the support elements 23, as will be explained presently. If it is desired to display articles on both the front and back side of the gondola display, the support assembly 70 may be further equipped with a second retention rod 72' which is fixed by fingers 73' to tubular member 71 in the manner previously described. This alternate arrangement is indicated in FIG. 8 of the drawings whereat the second retention rod and its supporting fingers 72' and 73', respectively, are indicated in dotted lines.

Figure 9:
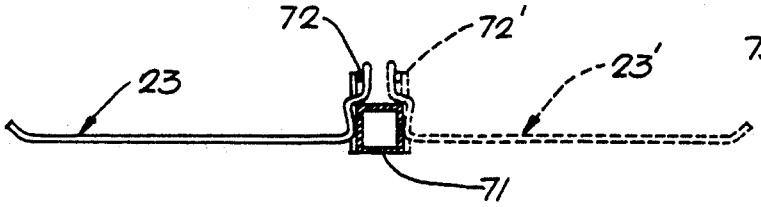
FIG. 9 is a partial cross sectional view corresponding to FIG. 8, but at a reduced scale therefrom, showing an article support element attached to the crossbar assembly and indicating in dotted lines a modified assembly having two retention rods.

Utilization of the alternate or modified article support assembly 70 with double retention rods 72 and 72' is illustrated in FIG. 9 of the drawings from which it will be understood support elements 23 and 23' are adapted to be coupled to their respective retention rods 72 and 72' . In this manner articles to be displayed may be mounted on opposite sides of the gondola display thereby doubling the display capacity of the extension assembly 21 of this invention.

Figure 12:
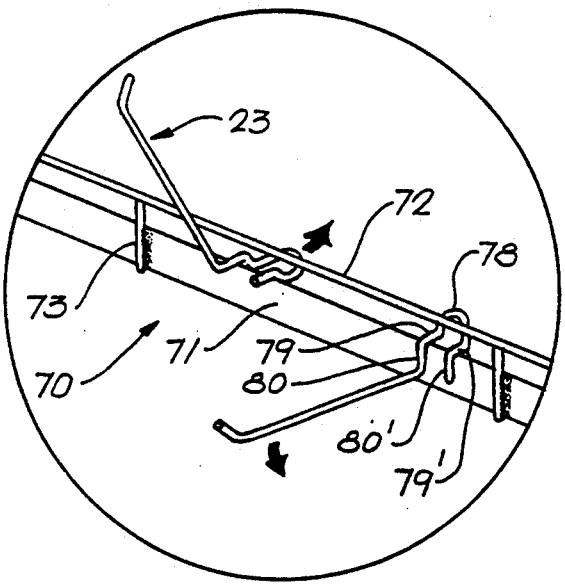
FIG. 12 is a partial enlarged perspective view illustrating the procedure for attaching an article support element to a horizontal crossbar assembly.
Figure 10:
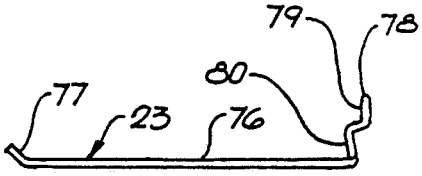
FIG. 10 is a side elevation of an article support element shown in FIG. 1.
Figure 11:
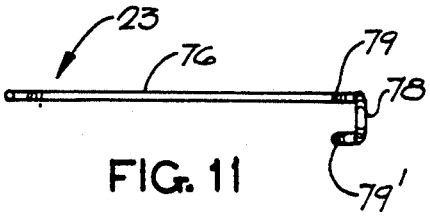
FIG. 11 is a top plan view of the support element shown in FIG. 10.

Turning now to the particulars of the support elements 23, attention is directed to FIGS. 10–12 of the drawing from which it will be understood that each support element comprises a length of heavy metal wire having a linear body portion 76, one outer end of which is upturned as at 77 to provide a retention portion to deter accidental removal of display package therefrom. The opposite end of body 76 is formed with a U-shaped harp or tongue indicated at 78 which extends to one side of the main axis of body portion 76 (see FIG. 11) and is joined to the body portion by an intermediate double bend forming arm portion 79 and leg portion 80 which are transversely related. Similarly, the free end of the U-shaped portion 78 is bent to form arm portion 79' and leg portion 80', each of which parallels its respective counterpart 79 and 80; the U-shaped portion 78 extending between the upper ends of the arm portion 79, 79' as best shown in the perspective showing of FIG. 12.

As shown best in FIG. 12 mounting of the support elements 23 on the crossbar assembly 70, is accomplished simply by inserting the U-shaped portion 78 in the spacing between the retention rod 72 and the tube 71 followed by lowering the outer end of the element 23 until the arms 79, 79' and legs 80, 80' respectively engage the top wall of the tube 71 and the front wall thereof. In this fashion the support elements 23 are mounted in cantilever fashion to extend outwardly of the front wall of the crossbar tube 71 while the spacing between the legs 80 and 80', provided by the U-shaped portion 78 thereof, produces lateral stability to the element 23 in conjunction with the engagement of the U-shaped portion behind the retention rod 72' . It will be recognized that with this type of quick coupling connection between the support elements 23 and the crossbar assembly 70, the article supporting elements 23 are free to slide along the length of the crossbar tube 71 beneath the retention rod 72 as limited by the intervening support fingers 73.

In order to attach the crossbar assembly 70 to the extension members 40, 40 of assembly 21, a pair of adjustable bar connectors 84, 84 are provided; the details of which are best understood from FIG. 14 of the drawings, while the operative functioning thereof is best illustrated in FIGS. 1–4. As shown in these figures the bar connectors 84 comprise a pair of metal cube members 85 and 86 which are open on two opposite sides and fixed together in back-to-back relationship so that the central axes of the open sides of the two cubes are related at right angles to one another. The open sided cubes are suitably welded together, back-to-back at their intercontacting walls or faces. One wall 87 of cube 85 is provided with a threaded opening 88 for receiving a thumbscrew indicated by dotted lines at 89 in FIG. 14.

In a similar fashion one wall 90 of cube 86 and its opposing wall 91 are each provided with a central threaded opening 92 for receiving a thumbscrew 93 as shown in FIGS. 3 and 4. Provision of the two openings 90 in the cube 86 permits usage of the bar connectors on both right and left hand extension members 40, 40 so that the thumbscrews 93 can be placed on the inboard side of the extension members 40 as indicated in the assembly perspective of FIG. 1. It will be appreciated that that the cubes 85 and 86 of the connectors 84 have an inside dimensions greater than the outside dimension of the crossbar tube 71 and uprights 40 so that the two cubes may be slipped over the upper ends of the extension bars 40 and receive the horizontal crossbar therein. By tightening the thumbscrew 89 associated with the cube 85 the crossbar is rigidly affixed to the connectors 84. In a similar fashion tightening of the thumbscrews 93 associated with the cube 86 at an appropriate or selected elevation of the crossbar along the length of the uprights 40, 40 serves to lock the crossbar to the extension members at desired elevated position thereon.

While only one crossbar assembly 70 is illustrated in FIG. 1 of the drawings, it will be understood that depending on the length of the extension members 40, 40 and the size of the packaged articles 22 to be displayed more than one such crossbar assembly may be mounted on the vertical extension members 40 above the gondola assembly 20 and if desired may even be attached to the extension bars 40 between the adjustment brackets 52, 52 associated therewith.

From the foregoing it is believed that those familiar with the art will readily recognize and appreciate the novel advancement of this invention over the prior art and will understand that while the invention hereof has been described in association with a preferred embodiment thereof illustrated in the accompanying drawings, the same is subject to change, modification, alteration and substitution of equivalents without departing from the spirit and scope of the invention herein described which is intended to be limited only as may appear in the following appended claims.

The embodiments of the invention in which an exclusive property or privilege is claimed are defined as follows:

1. An extension assembly for attachment to a generally vertical merchandise display rack having two laterally spaced vertical uprights presenting a plurality of slotted openings for attaching horizontal crossbars thereto, comprising:

a pair of like tubular extension members each for increasing the height of a vertical display rack upright, a single slot hanger fixed intermediate the ends of each extension member comprising a hook portion projecting outwardly of said each extension member and insertable into a selected slotted opening in an associated one of the display rack uprights for loosely attaching said extension member thereto whereby to extend the vertical height thereof;

and a pair of adjustment brackets secured to each extension member for adjusting movements toward and away said associated one of said uprights;

said brackets being located vertically above and below an associated said slot hanger and being independently operable to engage the said associated one of said uprights on opposite sides of said hook portion engaged therewith whereby adjustable movements of said brackets serve to pivotally orient said extension member about said hook portion and to secure the same parallel to the display rack upright to which it is attached.

2. The combination of claim 1, and at least one crossbar assembly adjustably secured to and extending between said extension members, comprising a rigid tubular member, and at least one linear rod secured to said tubular member in spaced parallelism to the operably upper face thereof.

3. The combination of claim 2, and at least one cantilever support element having one end formed to be captured behind said one rod and engageable with said tubular member for removeably attaching the same to one side of said crossbar assembly.

4. The combination of claim 3, wherein said support element comprises a length of heavy wire comprising a linear body portion, a U-shaped tongue at one end of said body portion disposed to one side of the central axis of said body portion and integral with the latter via intervening transversely related arm and leg portions paralleled at the free end of said U shaped tongue by corresponding arm and leg portions.

5. The combination of claim 2, and adjustable bar connectors embracing the ends of said tubular member and said extension members for interconnecting the same, comprising adjustable means for frictionally locking said bar connectors to said tubular member and extension members.

6. The combination of claim 3, wherein said rod is joined to said tubular member by laterally spaced rigid supports fixed to and extending transversely between said rod and tubular member.

7. The combination of claim 6, wherein said support element is slidably moveable along said rod and tubular member between adjacent said supports.

8. The combination of claim 5, wherein said extension and tubular members have planar sides and square cross sections, and each of said bar connectors comprises two cubes each having two opposing open ides, said two cubes being rigidly joined in back-to-back relation with the open sides thereof aligned so that the central axes thereof are normal to one another, and said two cubes being dimensioned to receive said extension and tubular members therewithin.

9. The combination of claim 8, wherein said adjustable means comprise a pair of thumb bolts; each having threaded connection with one wall of each of said cubes.

10. The combination of claim 3, and a second linear rod secured to said tubular member in spaced parallelism with said one rod for attaching one or more support elements to the opposite side of said crossbar assembly.

* * * * *